US005450373A

United States Patent [19]

Kupiszewski et al.

[11] Patent Number: 5,450,373

[45] Date of Patent: Sep. 12, 1995

[54] APPARATUS FOR TRANSMITTING TWO FREQUENCY SIGNALS WITH AN ACOUSTIC PROJECTOR

[75] Inventors: Thomas Kupiszewski, Irwin; David Marschik, Export, both of Pa.

[73] Assignee: Westinghouse Electric Corporation, Pittsburgh, Pa.

[21] Appl. No.: 255,862

[22] Filed: Jun. 7, 1994

[51] Int. Cl.[6] ..... H04R 23/00

[52] U.S. Cl. ..... 367/142; 367/157; 367/172; 367/176; 367/162; 367/175

[58] Field of Search ..... 367/140, 142, 157, 172, 367/176, 162, 175

[56] References Cited

U.S. PATENT DOCUMENTS 4,633,119 12/1986 Thompson ..... 310/325
5,020,035 5/1991 Kompanek ..... 367/159
5,268,879 12/1993 Flanagan ..... 367/141

*Primary Examiner*—J. Woodrow Eldred

[57] ABSTRACT

An acoustic projector wherein a unitary acoustic resonator produces active sonar signals in more than one frequency band. The double-slotted resonator is coupled to a transducer which is capable of exciting the resonator in two, distinct, volumetric modes of vibration using two asymmetric, generally arcuate vibrating members. Transduction techniques can include variable reluctance or piezoceramic transduction. Internal cavity pressure release may be achieved by bladders, compliant tubes, and the like.

10 Claims, 6 Drawing Sheets

FIG. 6a
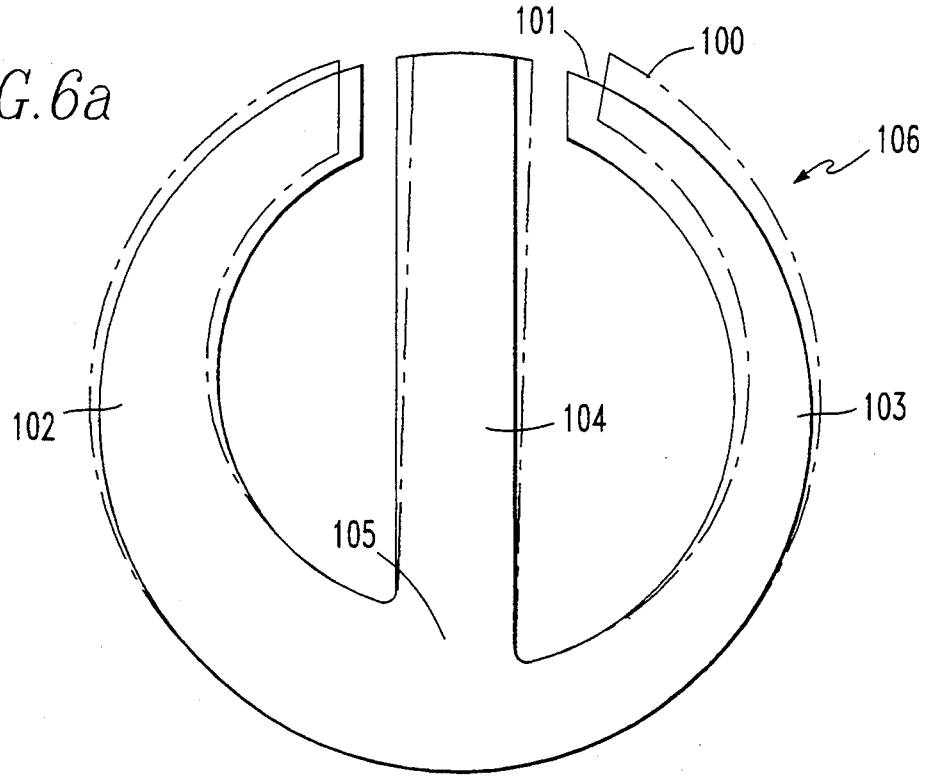
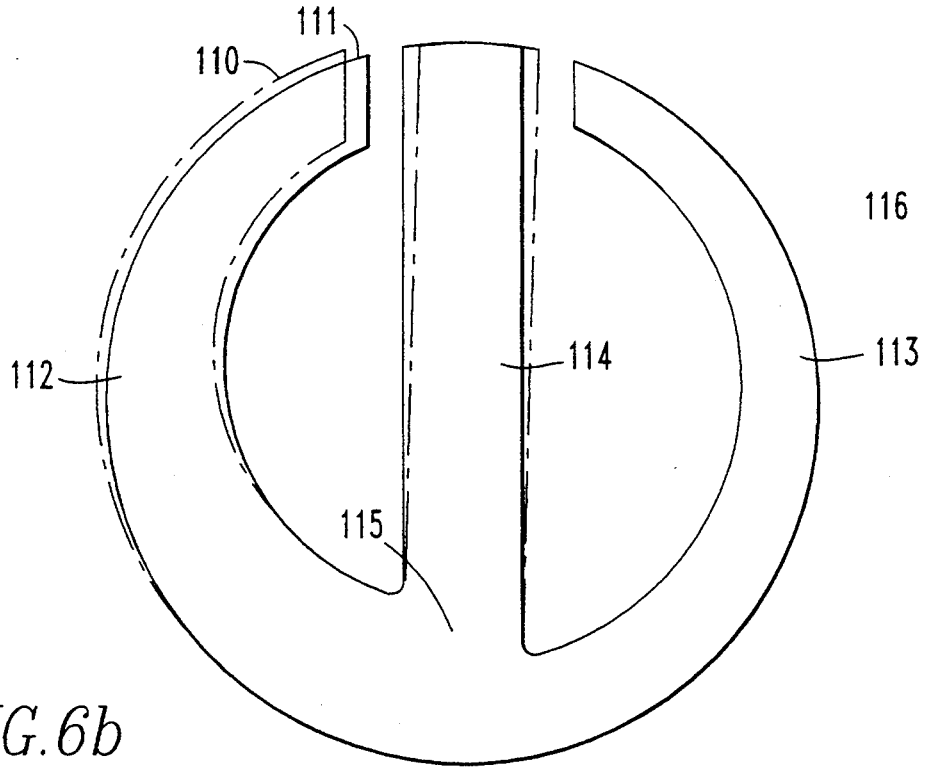
FIG. 6b

APPARATUS FOR TRANSMITTING TWO FREQUENCY SIGNALS WITH AN ACOUSTIC PROJECTOR

BACKGROUND OF THE INVENTION

1. Field of the Invention

This invention relates to sonar sources, in particular active sonar sources, and especially to multifrequency acoustic projectors, having transmit frequency bands which are widely separated in the frequency domain.

2. Description of the Prior Art

In general, generating active sonar signals in multiple frequency bands is of interest for two reasons. First, different types of objects of interest, or targets, need to be insonified in different frequency regimes. Second, sonar systems may be required to operate in shallow water and deep ocean environments, both of which present different, frequency-dependent signal propagation problems. Current practice in the design of acoustic projectors which are capable of transmitting in multiple frequency bands requires the design and construction of separate acoustic projectors for each desired transmit frequency, and the assembly of the individual projectors into an acoustic projector array. The number of different acoustic projector designs in the array usually equals the number of desired frequency bands for signal generation.

For example, in a two-frequency-band array, some fraction of the array projectors is designed to resonate at one common frequency while the remainder of projectors in the array is composed of acoustic projectors which are designed to resonate at a frequency different from that of the first fraction of the array.

This approach is hardware-intensive and may result from current acoustic projector architectures which typically possess only a single, in-water, volumetric mode resonance frequency. Another description for a volumetric mode is a "breathing" mode which is excited at its fundamental frequency. Examples of such architectures include Tonpilz, bender bars, baffled and unbaffled vibrating pistons, baffled and unbaffled flexural disks, flooded rings, and split cylinders. For an example of an acoustic projector with a single volumetric mode shape using a split cylinder transducer, see U.S. Pat. No. 5,020,035 issued to Kompanek.

SUMMARY OF THE INVENTION

The invention provides for a single active sonar signal projector which is capable of transmitting sonar signals in two frequency bands. The architecture of the projector couples a sonar transducer to its acoustic environment and configures the projector's structural elements so that two, distinct, volumetric modes of vibration can be excited by a suitable transduction technique. In the present invention such transduction techniques can include, for example, variable reluctance or piezoceramic transduction.

In embodiments employing variable reluctance transduction, a variable reluctance transducer (VRT) core shape can be characterized by an intentional asymmetry configured to create two volumetric mode shapes occurring at widely-spaced resonance frequencies. In one present preferred embodiment, a VRT consists of a double-slotted ferromagnetic projector core which is energized by a multi-turn electrical coil wound upon an insulated bobbin. Each of the two core slots are longitudinally-disposed axial slots. Several spring-like retainer clips are used to locate and attach the bobbin relative to a centrally-located core stem which extends through the bobbin. The base of the core stem diverges into two scythe-like segments, each of which form an acoustic radiator. The core can be composed of insulated metal laminae that are held together by fasteners which perpendicularly pass through the laminae.

A sheath, typically of rubber, can be affixed to the core. This sheath, or boot, can provide acoustic coupling of vibrating surfaces to the vibrating medium, as well as provide a barrier between the interior of the projector and the external environment.

In a second present preferred embodiment employing variable reluctance transduction, the core can be exposed to the acoustic medium and the interior cavity of the projector may be free-flooded with acoustic medium. In this embodiment, bladders, preferably composed of rubber and preferably pressurized with air or an inert gas to a preselected pressure, are inserted within the interior cavity between the core stem and each acoustic radiator.

In a third present embodiment according to the invention herein, compliant tube packs, which also may be pressurized with air or an inert gas to a preselected pressure, are inserted within the interior cavity between the core stem and each acoustic radiator. It is preferred to not enshroud the projector of the second and third embodiments within a boot.

In a fourth preferred embodiment employing piezoceramic transduction, an outer projector support with a longitudinally-disposed axial slot may be surrounded by a sheath, preferably made of rubber. Fitted within the support can be a piezoceramic resonator which also has an axial slot. Fitted within the piezoceramic resonator can be a central projector insert which may have two scythe-like segments arising from a common base in which a central stem may be interposed. In cooperation with the piezoceramic resonator and the outer support, the two scythe-like segments each may form an acoustic radiator.

Although the embodiments herein feature geometric topologies based upon circular arcs, other topologies may be derived from other mathematical functions including spline functions.

Other details, objects, and advantages of the invention will become apparent as the following description of certain present preferred embodiments thereof proceeds. The accompanying drawings show presently preferred embodiments of the invention.

BRIEF DESCRIPTION OF THE DRAWINGS

FIG. 6*a* is a diagram similar to FIG. 5 which illustrates deflected and an undeflected core profile outline models for a low-frequency volumetric mode shape.

FIG. 6*b* is a diagram also similar to FIG. 5 which illustrates deflected and an undeflected core profile outline models for a high-frequency volumetric mode shape.

DESCRIPTION OF THE PREFERRED EMBODIMENTS

Figure 1:
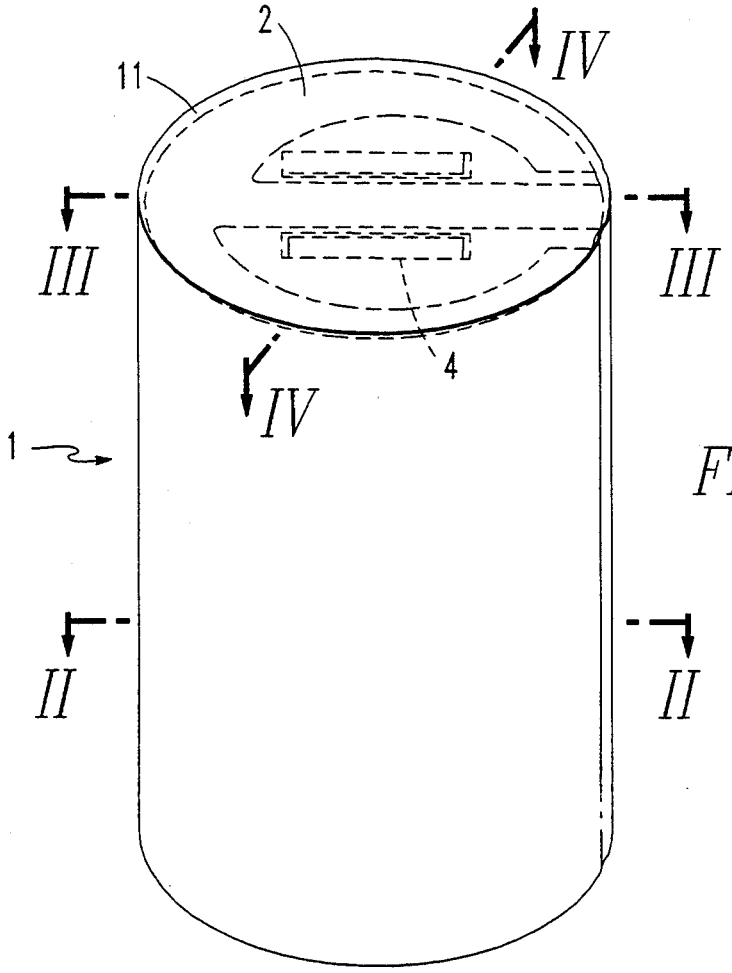
FIG. 1 is a view showing the basic structure of an acoustic projector according to the present invention.

As shown in FIG. 1, acoustical projector 1 is basically a cylindrical core 2 having a central insulated bobbin 4, which core 2 optionally is surrounded by a boot or sheath 11. Various internal configurations shown in FIGS. 2, 7, 8 and 9 can be used.

Figure 2:
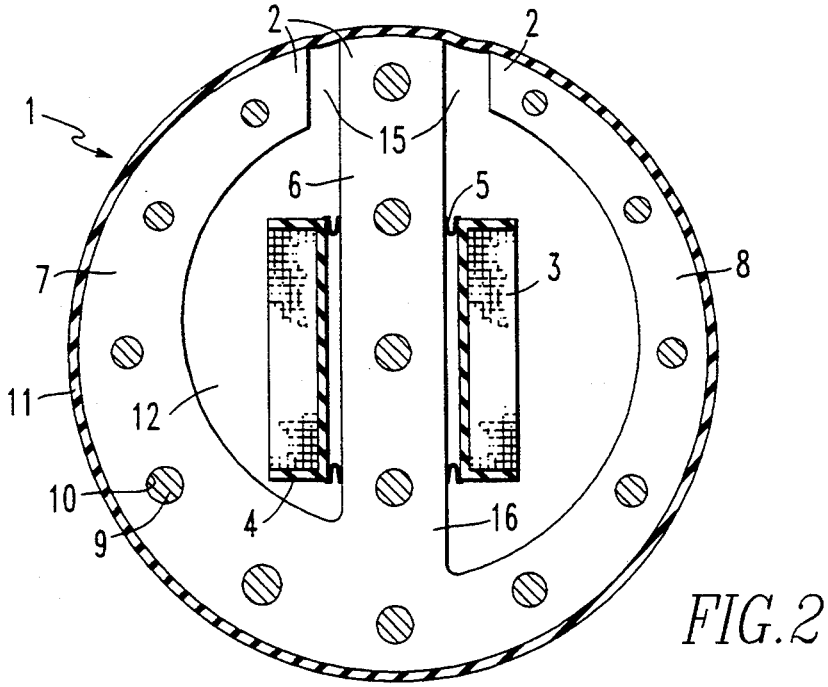
FIG. 2 is an axial cross-section taken along the line II—II of FIG. 1 which shows the internal configuration of one embodiment of an acoustic projector according to the present invention.

In a first present preferred embodiment, shown in axial cross-section in FIG. 2, acoustic projector 1, which employs variable reluctance transduction, consists of a double-slotted ferromagnetic projector core 2 which is energized by a multi-turn electrical coil 3 wound upon an insulated bobbin 4. When an electrical signal is introduced into coil 3, projector 1 vibrates.

In general, the shape of core 2 is characterized by a preselected asymmetry configured to create two volumetric mode shapes occurring at widely-spaced resonance frequencies. Spring-like retainer clips, 5, are used to locate and attach bobbin 4 relative to a centrally-located core stem 6 which extends through the throat of bobbin 4. The base of core stem 6 diverges into two, tapered, scythe-like segments, forming a left-side acoustic radiator 7 and a right-side acoustic radiator 8. The acoustic radiators are disposed around the core stem such that two longitudinally-disposed axial slots are formed.

It is preferred that the base of one radiator 7 be thicker than the base of the other radiator 8. Core 2 can be comprised of insulated metal laminae, such as, for example, a stack of insulated steel punchings, that are held together by fasteners, 9, such as, for example, threaded rods, bolts, screws, or rivets, which perpendicularly pass through fastener apertures 10 in the laminae. However, instead of steel punchings, core 2 could also be fabricated by machining ferrite or by sintering iron powder.

In this present preferred embodiment, the entire core 2 may be surrounded by a suitable sheath or boot 11 which is composed of rubber, preferably of buna or rho-c type, and can be affixed to core 2 by means of an adhesive. It is preferred that the rubber boot is acoustically transparent. It is further preferred to entrap within boot 11 a gas, such as, for example, air or an inert gas, to fill the interior cavity 12 of the device. The pressure of gas may be adjusted to provide hydrostatic depth compensation via pressurization to less than or equal to the ambient pressure at operating depth. Boot 11 can prevent the escape of such gas into the environment and the inrush of the acoustic medium, typically sea water, into interior cavity 12. Also, it may be desirable to fill cavity 12 with a fluid such as castor oil. In this circumstance, the boot also prevents the escape of the fluid into the external environment. In addition, boot 11 can acoustically couple vibrating surfaces to the acoustic medium and can isolate interior cavity from a corrosive, external environment, thereby protecting electrical components within projector 1.

Figure 3:
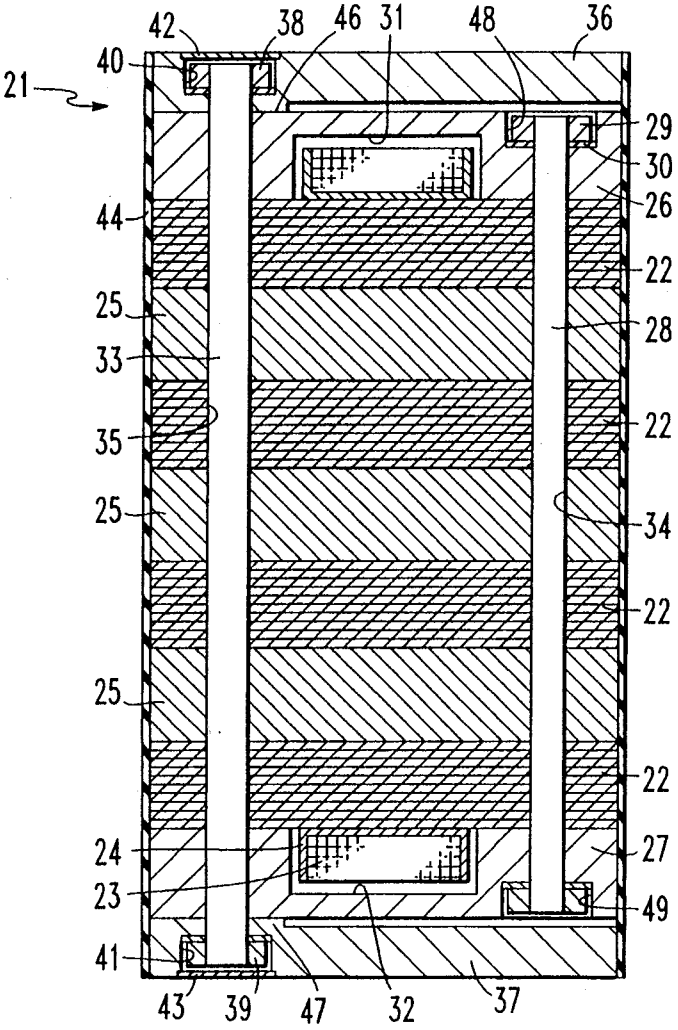
FIG. 3 is an illustration of a longitudinal cross-section of an acoustic projector according to the present invention, where the plane of the cross-section is indicated by the line III—III of FIG. 1.

In FIG. 3, acoustic projector 21 is illustrated in profile. Laminations are often used in magnetostrictive materials to ameliorate the effects of eddy currents within the transducer materials. Spacers 25 separate the projector core into core lamination stacks 22. Core stacks 22 are energized by electrical coil 23 wound upon bobbin 24. Spacers 25 can decrease mechanical Q by simultaneously increasing the active surface area of the core and decreasing the effective inertia per unit surface area of the core. By decreasing mechanical Q of a transducer, the bandwidth of the vibrational frequencies of acoustic projector 21 becomes increased.

It is preferred that spacers 25 be fabricated of material which has both a lower mass per unit volume than, and a very low magnetic permeability relative to, the material of which core stacks 22 are fabricated. Materials suitable for spacer material can include, for example, aluminum, titanium, plastics, carbon fiber composites, or chopped fiber composites. In the case of electrically-conductive materials, spacers 25 could have an electrically-insulative coating. Such coatings may include, for example, rubber, varnish, or flame- or plasma- sprayed refractory oxides such as aluminum oxide, zirconium oxide, or beryllium copper oxide. Typical coating thicknesses may range from 0.0001 to 0.015 inch, and it is preferred that coating thickness be between 0.002 to 0.010 inch. It is also preferred that spacers be approximately of the same size in each projector, with preferred thickness ranging from 1/20 to $\frac{1}{3}$ of the axial diameter of projector 21.

In addition, it is preferred that the thickness of each lamina of stacks 22 is substantially less than the thickness of each spacer 25. For example, in the presently preferred embodiment, each lamina of core stacks 22 may range from about 1/10,000 to 1/100 of the axial diameter of projector 21 with a typical lamina thickness of between 0.002 to 0.016 inch. It is preferred that each of the lamina in each of stacks 22 be of the same thickness.

Each of core stacks 22 are composed of multiple layers. Each layer may consist of as many as 10,000 laminae, with a typical stack having between fifty (50) and one-thousand (1,000) laminae. Although it is preferred to do so, there is no requirement to create each of stacks 22 with an identical number of laminae. Also, the operating frequency, bandwidth (Q) and acoustic power output characteristics of acoustic projector 21 may be selected by selecting the number of core stacks 22 used to construct projector 21.

It also is preferred to provide compressive preloading to stacks 22 by applying an amount of torque sufficient to ensure that the static friction load, which would be required to delaminate stacks 22 is less than the maximum dynamic loading encountered during operation. Accordingly, core lamination stacks 22 and spacers 25 are preferred to be disposed between upper clamp plate 26 and lower clamp plate 27. It is preferred that spacers 25 have a layout identical to core stacks 22 including the location and diameter of apertures 34, 35 created for the insertion of compressive fastener 28 and closure fastener 33, respectively.

Plates 26, 27 may be held in approximation by a plurality of compressive fasteners 28. In FIG. 2, such fasteners can be represented by fastener 9. Compressive nuts 29 can be attached to either end of compressive fastener 28 to impress a force upon clamp plates 26, 27. It is preferred to provide recesses 48, 49 to accommodate nuts 29. It also is preferred to interpose washers 30 between nuts 29 and plates 26, 27. The desired compressive preloading imposed upon stacks 22 is achieved by applying a preselected torque to compressive nuts 29 which are attached to fastener 28. In order to accommodate coil 23 and coil bobbin 24, as they wrap around the assembly of core stacks 22 and spacers 25 it is preferred to provide recess 31 in plate 26 and recess 32 in plate 27.

It is desirable to provide hydrostatic depth compensation to projector 21. Therefore, in this present preferred embodiment, it is preferred to enclose one end of projector 21 by attaching end cap 36 to upper clamp plate 26, distal to core stack 22. Similarly, it is preferred to enclose the other end of projector 21 by attaching end cap 37 to lower clamp plate 27, distal to core stack 22. Closure fastener 33 can maintain end caps 36, 37 in respective relative approximation with plates 26, 27 by passing through core stacks 22, spacers 25, clamp plates 26, 27 and end caps 36, 37. To either end of closure fastener 33 can be attached closure nuts 38, 39 to provide the desired amount of compressive force to effect the desired clamping force. Note that recesses 40, 41 can be provided in end caps 36, 37, to accommodate nuts 38, 39, respectively. End caps 36, 37 make positive contact with clamp plates 26, 27, respectively, by means of lands 46, 47, each of which has been machined on the interior faces of end caps 36, 37, respectively. This contact between end caps 36, 37 and plates 26, 27, occurs in a region where core motion is effectively zero, but simultaneously provides clearance to allow high velocity of the core stem 6, left-side radiator 7, and right-side radiator 8, as seen in FIG. 2, to proceed substantially unimpeded. Lands 46, 47 act to distribute the compressive force exerted by nuts 38, 39 on closure fastener 33 across a greater amount of the surface of plates 26, 27.

To prevent environmental intrusion via circumferential leakage about fastener 33 within recesses 40, 41, hermetic seals 42, 43 can be attached to the exterior surfaces of end caps 36, 37, which are distal to plates 26, 27, and are superior to recesses 40, 41, respectively. Sheath, or boot, 44 preferably made of buna or rho-c rubber, enshrouds the circumference of projector 21, covering the exterior circumferences of end caps 36, 37, plates 26, 27, spacers 25 and core stacks 22.

Figure 4:
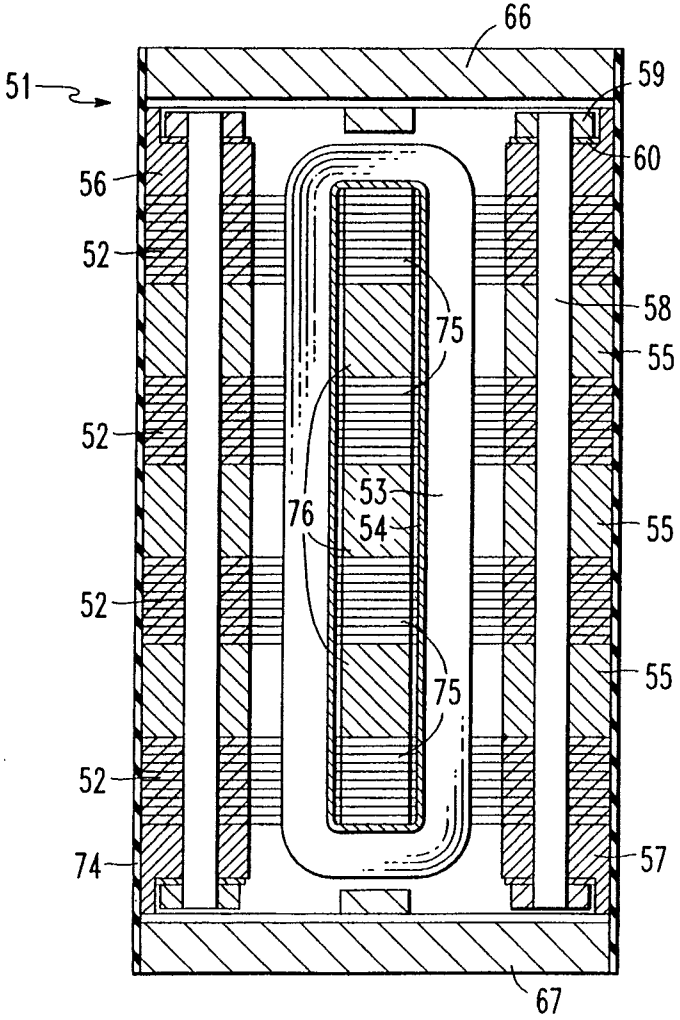
FIG. 4 is an illustration of a longitudinal cross-section of an acoustic projector according to the present invention, where the plane of the cross-section is indicated by the line IV—IV of FIG. 1.

Similar to FIG. 3, core stacks 52 of FIG. 4 can be separated by spacers 55. However, as shown in FIG. 4, coil 53 passes through stacks 52 and spacers 55 with coil 53 supported on bobbin 54. Bobbin 54 and coil 53 can be positioned around the projections of core stem 75 and spacer projections 76. A spacer stem projection 76 can be interposed between each adjacent pair of core stem projection 75.

Similar to the regime in FIG. 3, compressive preloading of stacks 52 in FIG. 4 can be effected by compressive forces exerted along compressive fastener 58 by compressive nuts 59 as distributed by clamp plates 56, 57, in conjunction with washers 60, respectively. End caps 66, 67 provide for closure of the ends along the longitudinal axis of projector 51. Sheath 74 provides a hermetic seal against environmentally-induced damage around the circumference of projector 51.

Figure 5:
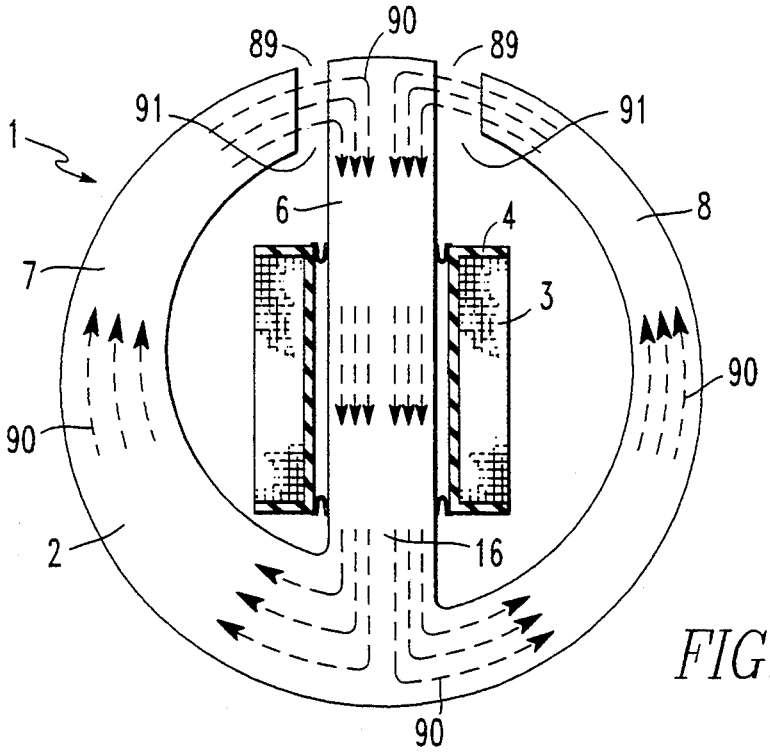
FIG. 5 is a diagram of the axial cross-section of FIG. 2 on which the sources of the magnetomotive forces which are used to actuate the acoustic projector are shown.

The resonant action of a VRT core can be actuated by applying to a projector core a variable magnetic force. Turning to FIG. 5, electrical coil 3, supported on bobbin 4, provides a source of magnetomotive force which can act as a driving potential for circulation of magnetic flux 90 within core 2 of projector 1. Flux 90 travels through the core stem 6, bifurcates at the core stem base 5, flows up through the respective left-side radiator 7 and right-side radiator 8, across gaps 89 and back into core stem 6. The actuating force may be applied perpendicularly to the surfaces of gaps 89 which are defined by the core slots 91, respectively. The actuating magnetomotive force is attractive, pulling left-side radiator 7 and right-side radiator 8 toward stem 6. Coil 3 can be energized by an AC current or AC voltage waveform which is applied to terminals of coil 3.

FIGS. 6*a* and 6*b* illustrate the mode shapes for a 4.5 inch diameter device. These mode shapes were determined by constructing two-dimensional finite element model of the VRT core with a finite element analysis computer program. In FIG. 6*a*, the deflected core profile outline 100 characterizing a low-frequency volumetric mode shape is illustrated as well as the undeflected core profile outline 101. Similarly in FIG. 6*b*, the deflected core profile outline 110 characterizing a high-frequency volumetric mode shape is illustrated as well as the undeflected core profile outline 111.

In the low-frequency model of FIG. 6*a*, the low-frequency mode occurs at approximately 933 Hz in vacuo. In this model, both left-side radiator 102 and the right-side radiator 103 move in phase in a direction which is away from the stem portion. At the same time, the core stem portion 104 bends toward the left-side radiator 102, with an effective "hinge" point located near base 105. Because, in this embodiment, a rubber boot may encase the core, thereby entrapping compressible gas within the device interior, the in-phase motion of both radiating sides 102, 103 may result in a net change in volume for the entire acoustic radiator 106. This net volumetric change would be responsible for producing the critical monopole content of a low-frequency acoustic radiation field which would be generated when acoustic projector 106 is completely submerged in water and energized.

In the high-frequency model of FIG. 6*b*, the high-frequency mode occurs at approximately 1460 Hz in vacuo. In this model, only left-side radiator 112 moves outward, out of phase with the bending motion of stem portion 114, while right side radiator 113 remains virtually motionless. As in the model of FIG. 6*a*, a rubber boot may encase the core and the deflection of the left-side radiator 112 results in a net volumetric change for the entire acoustic projector 116, thereby generating an acoustic radiation field with a dominant monopole content. In the models of both FIGS. 6*a* and 6*b*, increased inertial loads, resulting from submergence in water, would act to decrease both resonance frequencies by several hundred Hertz below the in-vacuo values, but would not significantly alter the mode shapes.

Figure 7:
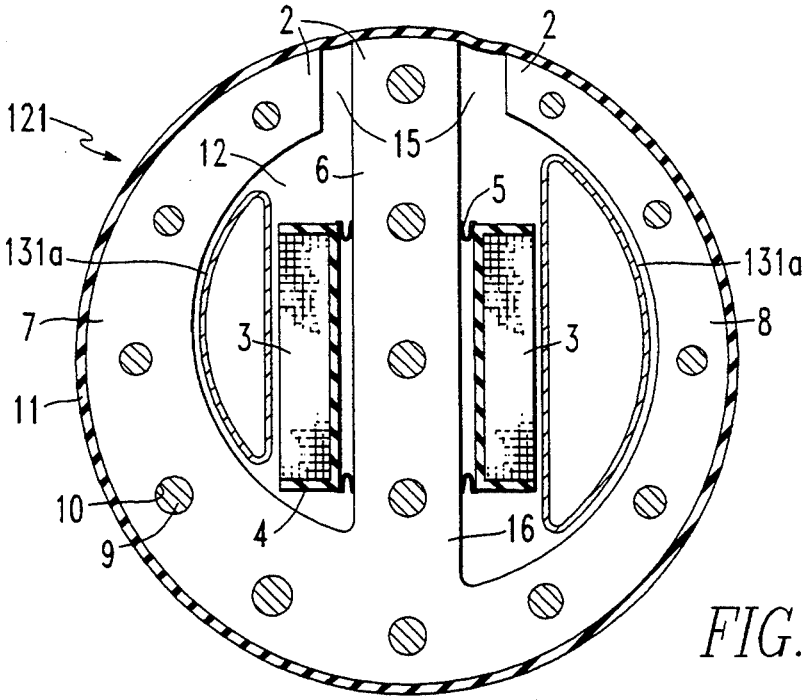
FIG. 7 is an axial cross-sectional view similar to FIG. 2 which shows the internal configuration of a second embodiment of an acoustic projector according to the present invention.

Turning to FIG. 7, a second present preferred embodiment of the invention herein is illustrated. This embodiment can employ variable reluctance transduction to generate the desired active sonar signal. Certain similarities may be noted between the resonator in FIG. 2 and acoustic projector 121 in FIG. 7. Projector 121 consists of a double-slotted ferromagnetic projector core 2 which is energized by a multi-turn electrical coil 3 wound upon an insulated bobbin 4. In general, the shape of core 2 is characterized by a preselected asymmetry configured to create two volumetric mode shapes occurring at widely-spaced resonance frequencies. Spring-like retainer clips 5, are used to locate and attach bobbin 4 relative to a centrally-located core stem 6 which extends through the throat of bobbin 4. The base 15 of core stem 6 diverges into two, tapered, scythe-like segments, forming a left-side acoustic radiator 7 and a right-side acoustic radiator 8.

It is preferred that the base of one radiator 7 or 8 is thicker than the base of the other radiator. Core 2 can be comprised of insulated metal laminae, such as, for example, a stack of insulated steel punchings, that are held together by fasteners 9 such as, for example, threaded rods, bolts, screws, or rivets, which perpendicularly pass through fastener apertures 10 in the laminae. However, instead of steel punchings, core 2 could also be fabricated by machining ferrite or by sintering iron powder.

In this present preferred embodiment, the entire core 2 may be exposed to the operating environment. In this case, interior cavity 12 may be free-flooded with the acoustic medium and gas-filled bladders 131*a*, 131*b* may be inserted within interior cavity 12 between core stem 6, and left-side radiator 7 and right-side radiator 8, respectively, to provide internal cavity compliance. It is preferred that each bladder 131*a*, 131*b* is composed of rubber, preferably of buna or rho-c type. It is further preferred to entrap within bladders 131*a*, 131*b* a gas, such as, for example, air or an inert gas, which may be pressurized to produce the desired cavity compliance within the interior cavity 12 of the device. The pressure of gas in bladders 131*a*, 131*b* may be adjusted to less than or equal to the ambient pressure at operating depth so that depth-dependent resonance frequency changes may be reduced. Individual bladder volume may be changed to control cavity compliance, thereby providing greater control over resonance frequency values.

Figure 8:
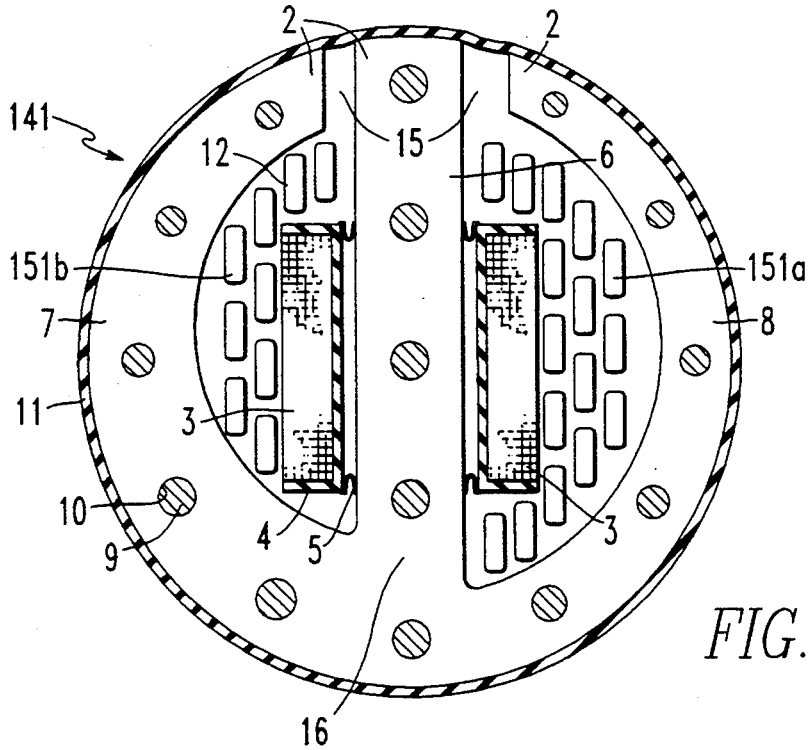
FIG. 8 is an axial cross-sectional view similar to FIG. 2 which shows the internal configuration of a third another embodiment of an acoustic projector according to the present invention.

FIG. 8 illustrates a third present preferred embodiment of the present invention. With the exception of bladders 131*a*, 131*b* shown in FIG. 7, acoustic projector 141 of FIG. 8 possesses similar components and features. As in FIG. 7, interior cavity 12 can be allowed to free-flood with the acoustic medium. However, unlike in FIG. 7, where internal cavity pressure release is provided by bladders 131*a*, 131*b*, in FIG. 8, internal cavity pressure release can be accomplished by compliant tube packs 151*a*, 151*b* being located between core stem 6 and left-side radiator 7 and right-side radiator 8, respectively. It also is preferred that each compliant tube pack 151*a*, 151*b* is composed of a semi-rigid but at least partially resilient material such as, for example, plastic or aluminum.

Figure 9:
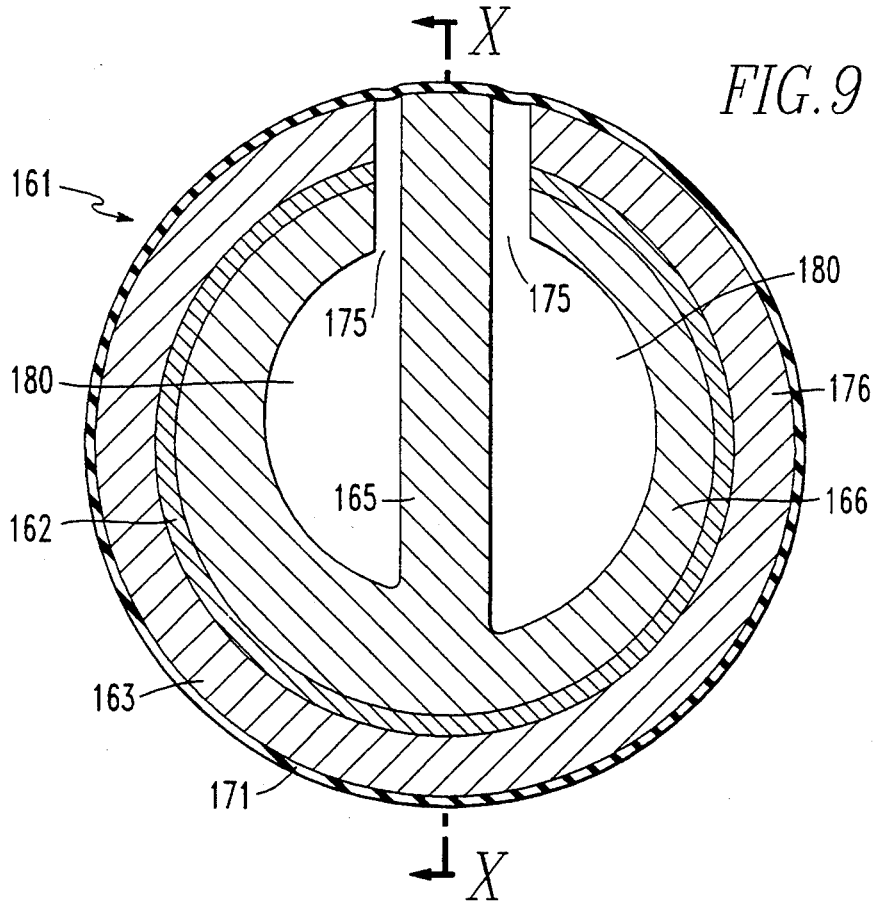
FIG. 9 is an axial cross-sectional view similar to FIG. 2 which shows the internal configuration of a fourth embodiment of an acoustic projector according to the present invention.

In addition to variable reluctance transduction, piezoceramic transduction may be used as a means of generating acoustic signals. FIG. 9 illustrates a fourth present preferred embodiment of acoustic projector 161 according to the invention herein. Piezoceramic resonator 162 is fitted into slotted projector support 163. Similarly, central projector insert 166 is fitted into resonator 162. It is preferred that the outer diameter of resonator 162 closely approximate the inner diameter of support 163 and that the outer diameter of insert 166 closely approximate the inner diameter of resonator 162. It is also preferred that support 163, resonator 162, and insert 166 are bonded together to form a unimorph bender. The resulting topology of this embodiment is similar to the topologies shown in FIGS. 2, 7 and 8. The unimorph bender has a core stem 165, the base 176 of which diverges into two scythe-like segments each of which form an acoustic radiator. As with the variable reluctance embodiments, the acoustic radiators are disposed around the core stem such that two longitudinally-disposed axial slots 175 are formed. The structure of acoustic projector can be enclosed by a sheath or boot, 171, which may be composed of rubber, preferably of the buna or rho-c type.

Figure 10:
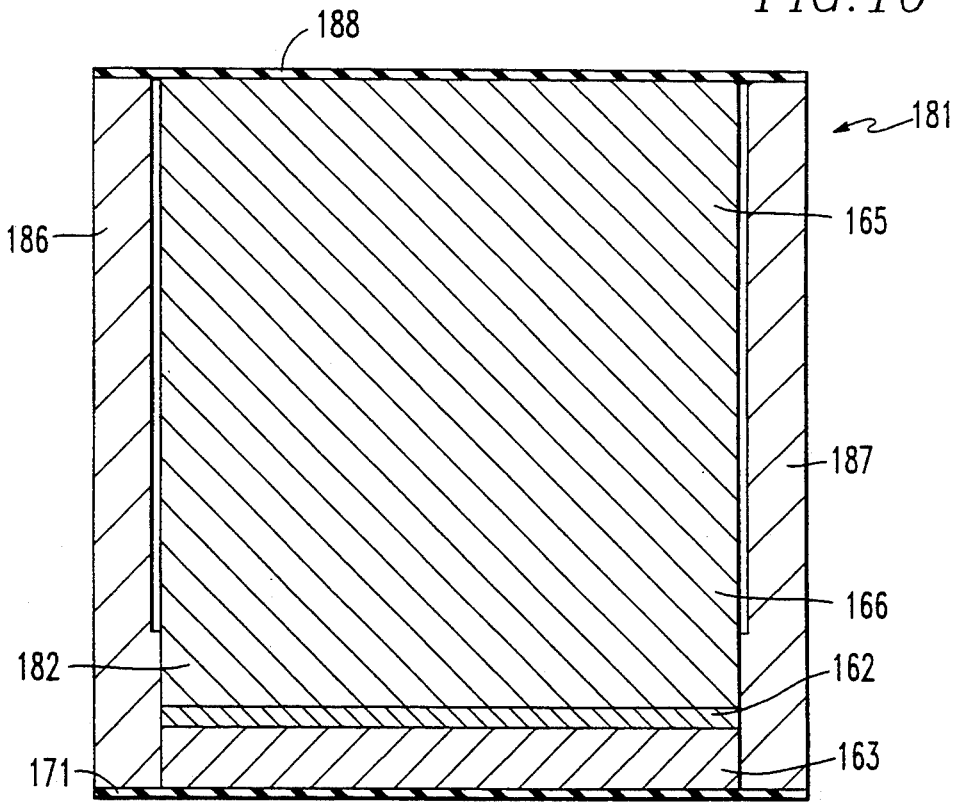
FIG. 10 is a longitudinal cross-sectional view of the embodiment of the acoustic projector of FIG. 9, where the plane of the cross-section is indicated by the line X—X of FIG. 9.

As shown in FIG. 10, whose plane is in the direction of the line X—X of FIG. 9, piezoceramic acoustic projector 181 is enclosed on either longitudinal end by end caps 186, 187. End caps 186, 187 may be attached near the base 182 of central projector insert stem 165. Compressive preloading of the piezoceramic resonator, however, would be provided by inward deflection of the composite structure due to hydrostatic pressure applied against boot 185. It is preferred that piezoceramic resonator 183, slotted projector support 184, and central projector core insert 188 are sized to position the neutral surface of insert 188 such that no stress inversion occurs within the piezoceramic material of resonator 183.

Figure 11:
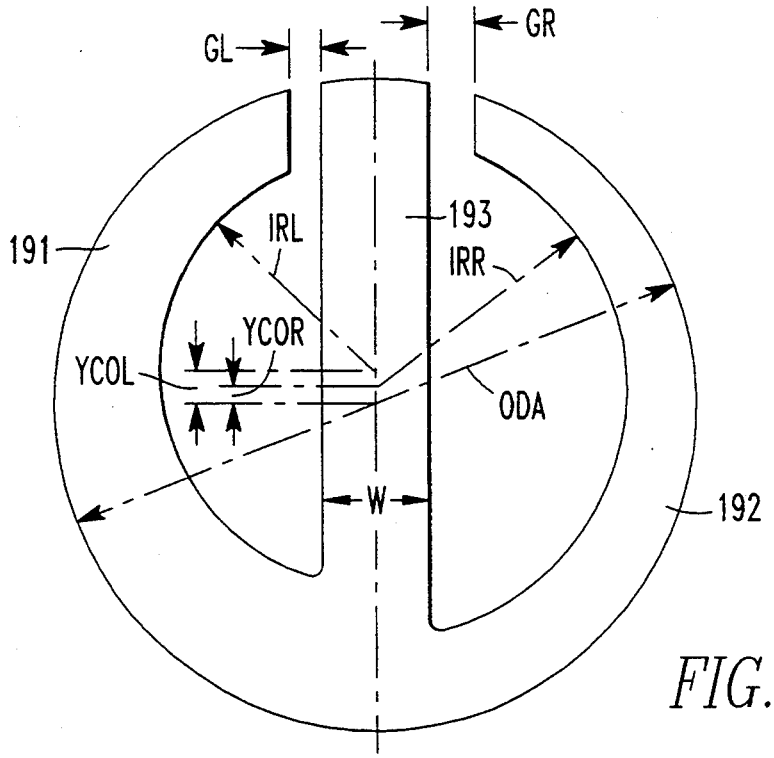
FIG. 11 is a diagram which illustrates geometric parameters in an axial cross-section of an embodiment of the present invention.

FIG. 11 illustrates eight geometric parameters which may be used to characterize the topology of the resonating structure of the presently preferred embodiments which have been presented herein. It is preferred to enforce structural asymmetry in order to achieve two volumetric mode shapes. The eight geometric parameters illustrated in FIG. 11 include: Left-side radiator 191 internal radius (IRL), right-side radiator 192 internal radius (IRR), core stem 193 width (W), left core gap (GL), right core gap (GR), outer diameter of the assembly (ODA), center point offset along Y-axis for left-side radiator (YCOL), and center point offset along Y-axis for left-side radiator (YCOR). Structural symmetry exists where IRL=IRR, YCOL=YCOR, and GL=GR. In the case of absolute symmetry, the resulting projector would have a single volumetric mode shape similar to that of a split cylinder, such as that found in U.S. Pat. No. 5,020,035. Instead, structural asymmetry can be achieved, for example, by enforcing at least one of the following geometric design shapes: IRL>IRR, YCOL>YCOR, or GL>GR. Tapering may be necessary to satisfy certain resonance frequency requirements. Tapering may be achieved by making YCOL>0, or YCOR>0, or both.

The invention provides an unitary acoustic projector that can transmit acoustic signals in two frequency ranges which uses may include active sonar signal transmission. Sonar signal transmission in more than one frequency band can enable one surveillance system to operate in more than one acoustic environment. Traditionally, this would entail multiple transmitter designs and an associated increase in the amount of transducer hardware, system cost, and difficulty of deployment.

Acoustic projectors according to the invention herein are unitary structures that can be resonated to generate acoustic signals with predominant monopole content in two frequency bands which are distinctly separated in the frequency domain. Such acoustic projectors can be scalable over a range of frequencies such as, for example, VLF and LF frequency ranges. In addition, the acoustic resonator structure may be resonated by either piezoceramic or variable reluctance transducers.

Present preferred embodiments of the invention include an acoustic projector structure which can be resonated to generate acoustic signals with predominant monopole content in two frequency bands which are widely spaced in the frequency domain. The topology of the structure exhibits two different volumetric mode shapes in the LF regime.

Although acoustic projectors having a slotted, split cylinder transducer have been used in the prior art to transmit active sonar signals, such projectors have a single volumetric mode shape, possess only one slot in the projector cylinder, and lack a central stem region which lies along the projector's plane of symmetry.

Although the embodiments herein feature geometric topologies based upon circular arcs, the topologies of dual frequency acoustic projectors according to the present invention may be derived from a myriad of mathematical functions including spline functions. In general, the aforementioned topologies provide for accommodation of a wide range of packaging envelopes, operation over a wide range of operating frequencies, and sufficient separation of both volumetric modes in the sub-kilohertz frequency domain to achieve true, two-band signal transmission instead of signal bandwidth augmentation.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the invention which is to be given the full breadth of the following claims and any and all embodiments thereof.

We claim:

1. An acoustic projector for transmitting acoustic signals comprising:.

a unitary acoustic resonator to generate a plurality of critical monopole frequencies and including a core, said core being axially annular and longitudinally cylindrical, said core having a plurality of longitudinally-disposed axial slots, a core base disposed at least partially in opposition to said slots, at least one core stem projecting upright from said core base along a plane of symmetry of said core, a plurality of asymmetrically arcuate radiating members extending upright from said core base, and a plurality of inner cavities, each of said inner cavities being disposed between selected ones of said plurality of said arcuate radiating members and selected ones of said at least one core stem wherein said at least one core stem is disposed at least partially between selected ones of said plurality of arcuate radiating members;

a means for internal cavity pressure release disposed in proximity with said core; and, transduction means, said transduction means connectable with said acoustic resonator, said transduction means exciting said acoustic resonator to generate such acoustic signals.

2. The acoustic projector of claim 1 wherein said transduction means is variable reluctance transduction.

3. The acoustic projector of claim 1 wherein said transduction means is piezoceramic transduction.

4. The acoustic projector of claim 1 wherein said means for internal cavity pressure release is pressurized to a preselected pressure.

5. The acoustic projector of claim 2 wherein said core is comprised of:

a plurality of core stacks, each of said core stacks having a plurality of laminae, said core positively susceptible to magnetic flux, each of said plurality of core stacks having core stack apertures, and each of said plurality of laminae enclosed within an electrically-insulative coating;

a plurality of spacers, each of said plurality of spacers interposed between respective ones of a pair of said core stacks, each of said spacers having spacer apertures, respective ones of said spacer apertures at least partially aligned with respective ones of said core stack apertures;

a bobbin at least partially surrounding said core;

an electrical coil operably connected to said core, said coil at least partially disposed on said bobbin;

at least one clamp plate, each of said at least one clamp plate disposed on one side of said core, each of said clamp plate having at least one clamp plate aperture;

a plurality of compressive fasteners, respective ones of said plurality of said compressive fasteners penetrating respective ones of said core stack apertures, respective ones of said plurality of said compressive fasteners penetrating respective ones of said spacer apertures, respective ones of said plurality of said compressive fasteners penetrating respective ones of said core stack apertures;

at least one end plate, each of said at least one end plate having at least one end plate aperture, each of said at least one end plate having at least one recess aligned with said at least one end plate aperture, each of said at least one end plate aperture aligned with respective ones of said core stack apertures;

at least one closure fastener, said at least one closure fastener penetrating said at least one end plate aperture, said at least one closure fastener penetrating respective ones of said core stack apertures which are aligned with said at least one end plate aperture; and at least one hermetic seal covering respective ones of said at least one recess of said at least one end plate.

6. The acoustic projector of claim 3 wherein said acoustic resonator further comprises:

an outer support cylinder having at least one longitudinally-disposed slot;

an inner core stem insert having an inner core stem, an outer dimension of said core stem insert being less than an inner dimension of said outer support cylinder, said inner core stem insert being disposed within said outer support cylinder, at least a portion of said inner core stem being disposed within one of said at least one longitudinally-disposed slot of said outer support cylinder; and a piezoceramic cylinder having at least one longitudinal slot, said piezoceramic cylinder being interposed between said outer support cylinder and said inner core stem insert, said at least one longitudinally-disposed slot of said piezoceramic cylinder being aligned with respective of said at least one longitudinally-disposed slot of said outer support cylinder.

7. The acoustic projector of claim 5 wherein each of said plurality of laminae of each of said core stacks is composed of a ferromagnetic material.

8. The acoustic projector of claim 5 wherein a material of said plurality of spacers is selected from a group consisting of aluminum, titanium, plastic, carbon fiber composites, glass fiber composites, chopped fiber composites, and combinations thereof.

9. The acoustic projector of claim 5 further comprising a means for internal cavity pressure release, said means for internal cavity pressure release is one of:

a plurality of bladders, each of said bladders being disposed within selected ones of said inner cavities of said acoustic resonator; and a plurality of compliant tube packs, each of said complaint tube packs being disposed within selected ones of said inner cavities of said acoustic resonator.

10. The acoustic projector of claim 5 further comprising a boot, said boot covering at least a portion of the outer surface of said plurality of core stacks, said boot covering at least a portion of the outer surface of said plurality of spacers, said boot covering at least a portion of the outer surface of said at least one clamp plate, said boot being disposed to cover at least a portion of said longitudinally-disposed axial slots, and said boot covering at least a portion of the outer surface of said at least one end plate.

* * * * *